US008398183B2

(12) United States Patent
Cheung

(10) Patent No.: US 8,398,183 B2
(45) Date of Patent: Mar. 19, 2013

(54) HANGING HOOK AND MODULAR STORAGE FURNITURE SYSTEM

(75) Inventor: Stephen K. C. Cheung, Shatin (HK)

(73) Assignee: Jetmax Ltd., Shatin, New Territories (HK)

( * ) Notice: Subject to any disclaimer, the term of this patent is extended or adjusted under 35 U.S.C. 154(b) by 291 days.

(21) Appl. No.: 12/563,626

(22) Filed: Sep. 21, 2009

(65) Prior Publication Data

US 2011/0068667 A1 Mar. 24, 2011

(51) Int. Cl.
*A47B 63/02* (2006.01)

(52) U.S. Cl. ..... 312/193; 312/352; 248/303

(58) Field of Classification Search ..... 312/237, 312/107, 108, 111, 257.1, 280, 282, 352, 312/183, 193, 184, 185, 187, 189; 24/369, 24/370, 907; 248/303, 304
See application file for complete search history.

(56) References Cited

U.S. PATENT DOCUMENTS 1,303,985 A * 5/1919 Straubel ..... 108/102
1,471,712 A * 10/1923 Sohnle ..... 206/362
1,623,824 A * 4/1927 Bondeson et al. ..... 402/1
2,593,998 A * 4/1952 Dupuis ..... 206/509
3,552,579 A * 1/1971 Simon et al. ..... 211/126.12
3,563,624 A * 2/1971 Stice ..... 312/111
4,064,604 A * 12/1977 Hartman ..... 24/601.1
4,400,043 A * 8/1983 Rossow ..... 312/111
5,058,964 A * 10/1991 Reuschel et al. ..... 312/111
5,415,370 A * 5/1995 Valiulis ..... 248/220.41
5,975,658 A * 11/1999 Verbeek et al. ..... 312/209
6,719,384 B1 * 4/2004 Parise et al. ..... 312/249.9
6,732,858 B1 * 5/2004 Chang ..... 206/278
2008/0074013 A1 * 3/2008 Ahlgrim et al. ..... 312/108

* cited by examiner

*Primary Examiner* — James O Hansen
(74) *Attorney, Agent, or Firm* — Amster Rothstein & Ebenstein LLP

(57) ABSTRACT

A hanging hook for attaching a generally vertical object to a vertical side wall of a piece of storage furniture, comprises: a central portion extending laterally for at least the distance of the width of said object; a first attachment portion at one end of said central portion, the first attachment portion including a leg section extending downward for securing said leg portion through an aperture in a top surface of said piece of storage furniture; and a second attachment portions at the opposite end of said central portion, the second attachment portion including a leg section extending downward and an arm section extending inward from a distal end of the first section toward the center of said hanging hook for securing said arm section through an aperture in an outer side surface of said object.

11 Claims, 5 Drawing Sheets

HANGING HOOK AND MODULAR STORAGE FURNITURE SYSTEM

FIELD OF THE INVENTION

The present invention relates to hanging hooks, and more particularly, a hanging hook for attaching a generally vertical object to a vertical side of a piece of storage furniture.

BACKGROUND OF THE INVENTION

Modular storage furniture is a popular inexpensive storage option in residential and office environments because it is configurable and adaptable for various uses. Oftentimes the modular storage furniture is purchased without doors, yet it may become desirable at some point to enclose or conceal items stored within the furniture. The additional time, effort, and cost required for the installation of permanent doors may be enough of an impediment to prevent the doors from being installed.

It may also be desirable to attach other objects to a vertical side of the storage furniture to provide additional functionality, such as a dry erase board, chalkboard, peg board, shelves, storage accessory or the like. Conventional hanging means may not be convenient for hanging the object over a side or an exposed opening of a vertical side the modular storage furniture. Moreover, if an object is hung on one of the side walls with a conventional hanging means, there will be unsightly holes that are left in the side of the furniture if it is later decided to remove the hanging object.

Accordingly, there is a need for a simple device that allows for the quick and inexpensive attachment of an object to a vertical side wall or an exposed opening of a piece of modular storage furniture.

SUMMARY OF THE INVENTION

According to one embodiment, a hanging hook for attaching a generally vertical object to a vertical side wall of a piece of storage furniture, comprises: a central portion extending laterally for at least the distance of the width of said object; a first attachment portion at one end of said central portion, the first attachment portion including a leg section extending downward for securing said leg portion through an aperture in a top surface of said piece of storage furniture; and a second attachment portion at the opposite end of said central portion, the second attachment portion including a leg section extending downward and an arm section extending inward from a distal end of the first section toward the center of said hanging hook for securing said arm section through an aperture in an outer side surface of said object.

In at least one embodiment, the leg section of the first attachment portion extends substantially vertically downward.

In at least one embodiment, the leg section of the first attachment portion is inclined inwardly.

In at least one embodiment, the leg section of the second attachment portion extends substantially vertically downward.

In at least one embodiment, the leg section of the second attachment portion is inclined inwardly.

According to one embodiment, a modular storage furniture system comprises: a piece of storage furniture; a board; and at least one hanging hook for securing the board oriented generally vertically to a vertical side wall of the piece of storage furniture, the hook comprising: a central portion extending laterally for at least the distance of the thickness of said board; a first attachment portion at one end of said central portion, the first attachment portion including a leg section extending downward for engagement through an aperture in a top surface of said piece of storage furniture; and a second attachment portion at the opposite end of said central portion, the second attachment portion including a leg section extending downward and an arm section extending inward from a distal end of the first section toward the center of said hanging hook for engagement through an aperture in an outer side surface of said board.

In at least one embodiment, the leg section of the first attachment portion of the hook extends substantially vertically downward.

In at least one embodiment, the leg section of the first attachment portion of the hook is inclined inwardly.

In at least one embodiment, the leg section of the second attachment portion of the hook extends substantially vertically downward.

In at least one embodiment, the leg section of the second attachment portion of the hook is inclined inwardly.

In at least one embodiment, the board comprises a flat plate and a storage accessory mounted on an outer side surface of the flat plate.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

Figure 1:
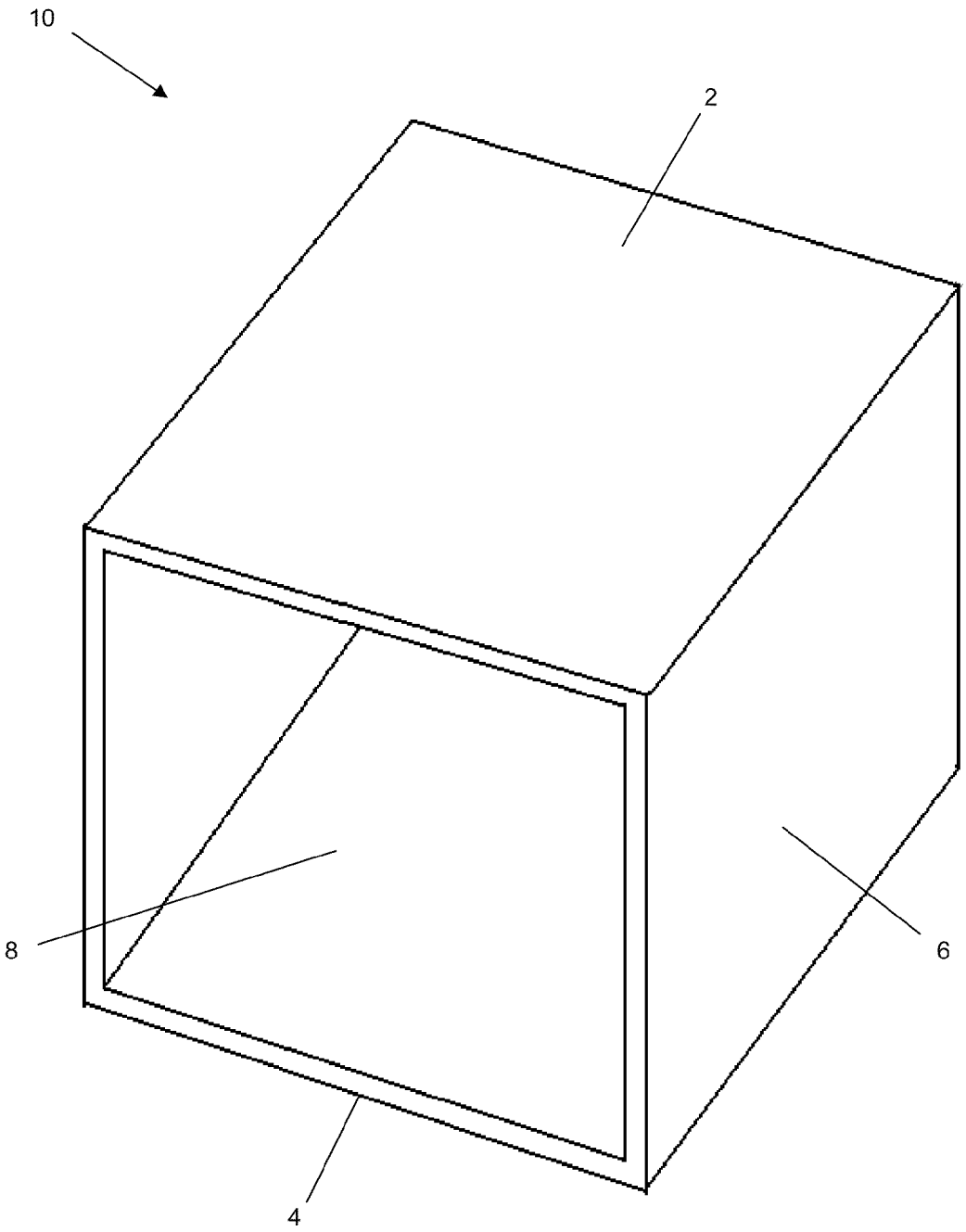
FIG. 1 is a perspective view of a piece of storage furniture.

FIG. 1 is a perspective view of a piece of storage furniture 10. The storage furniture illustrated in FIG. 1 is a modular storage cube having an upper wall 2, a bottom wall 4, and side walls 6. A cavity 8 is located between the walls of the cube in which shelves may be inserted to create additional organized storage space. The modular storage cube 10 shown does not include permanently installed cabinet doors at the front face, thus leaving the cavity open to the environment.

Figure 2:
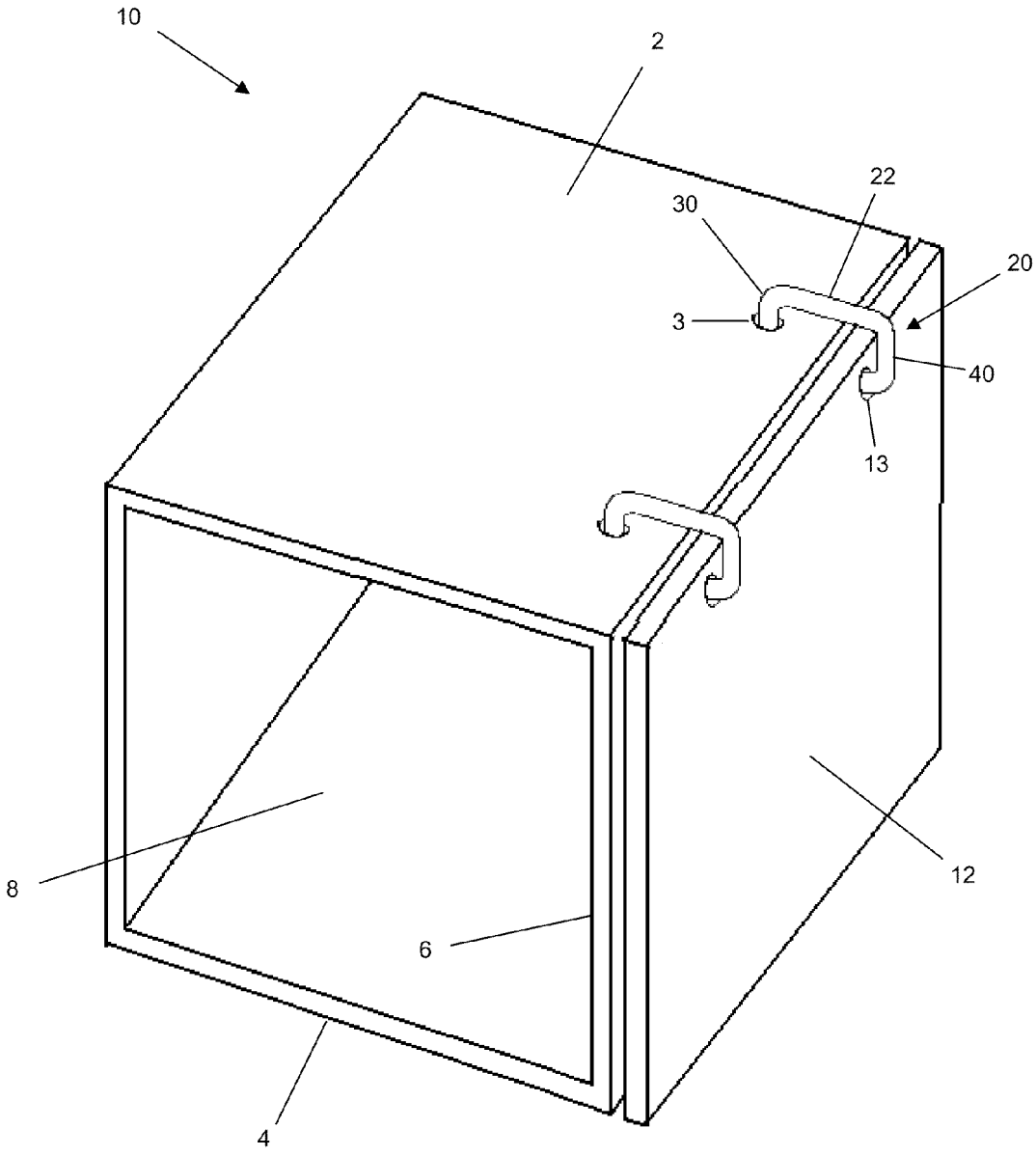
FIG. 2 is a perspective view of a hanging hook securing a vertically oriented board to the piece of storage furniture according to an exemplary embodiment of the present invention.

As shown in FIG. 2, a generally vertically oriented board 12 is hung from the upper wall 2 of the modular storage cube 10 on a vertical side wall of the modular storage cube 10. The board 12 may also be hung over the cavity 8 on the front face of the modular storage cube 10.

Figure 3:
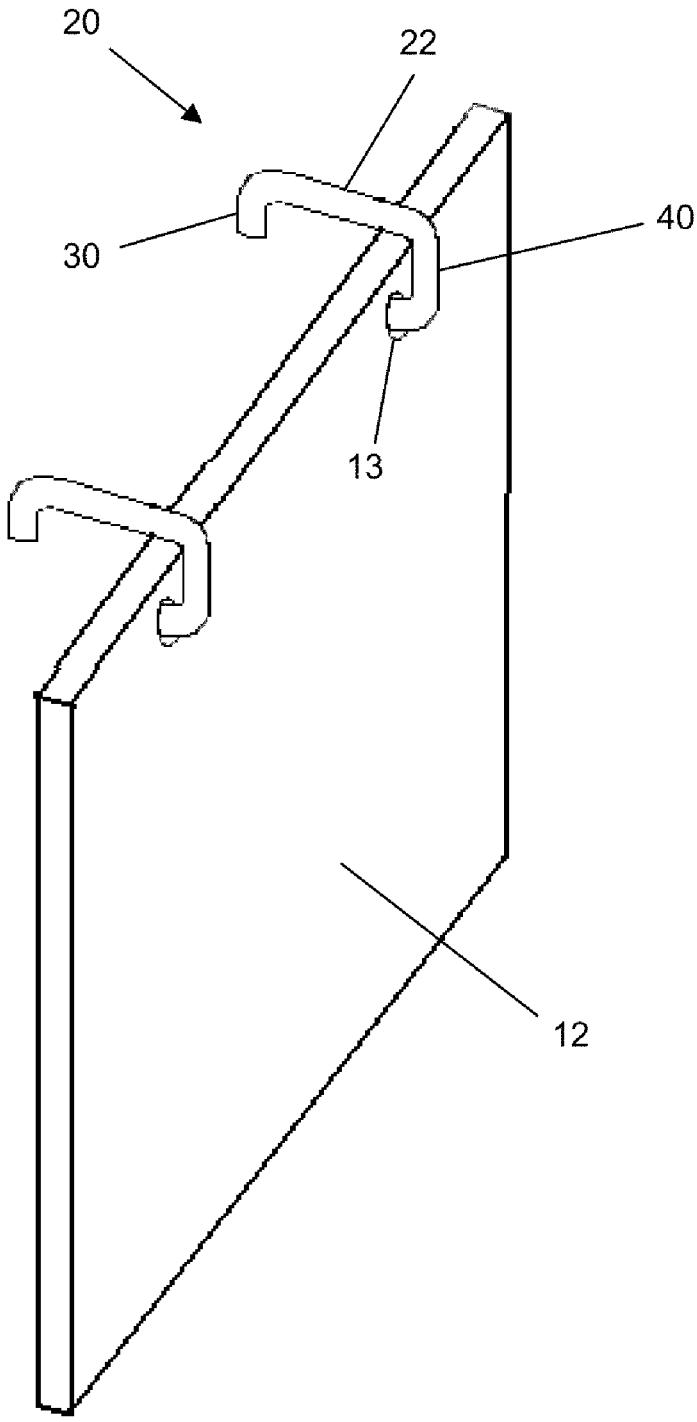
FIG. 3 is a perspective view of the hanging hook inserted into a vertically oriented board before attached to the piece of storage furniture.

To secure the board 12 in place on the modular storage cube 10, one or more hanging hooks 20, which are described in more detail below, are inserted through apertures 13 in the outer side surface of the board 12 and through apertures 3 in the upper wall 2 of the modular storage cube 10 Multiple hooks 20 may be spaced apart at intervals along the board 12 and the modular storage cube 10 for a more secure attachment. An intermediate step of assembly is illustrated in FIG. 3 in which the hook 20 is inserted through the board 12 before it is attached through the apertures 3 in the upper wall 2 of the modular storage cube 10.

Figure 4:
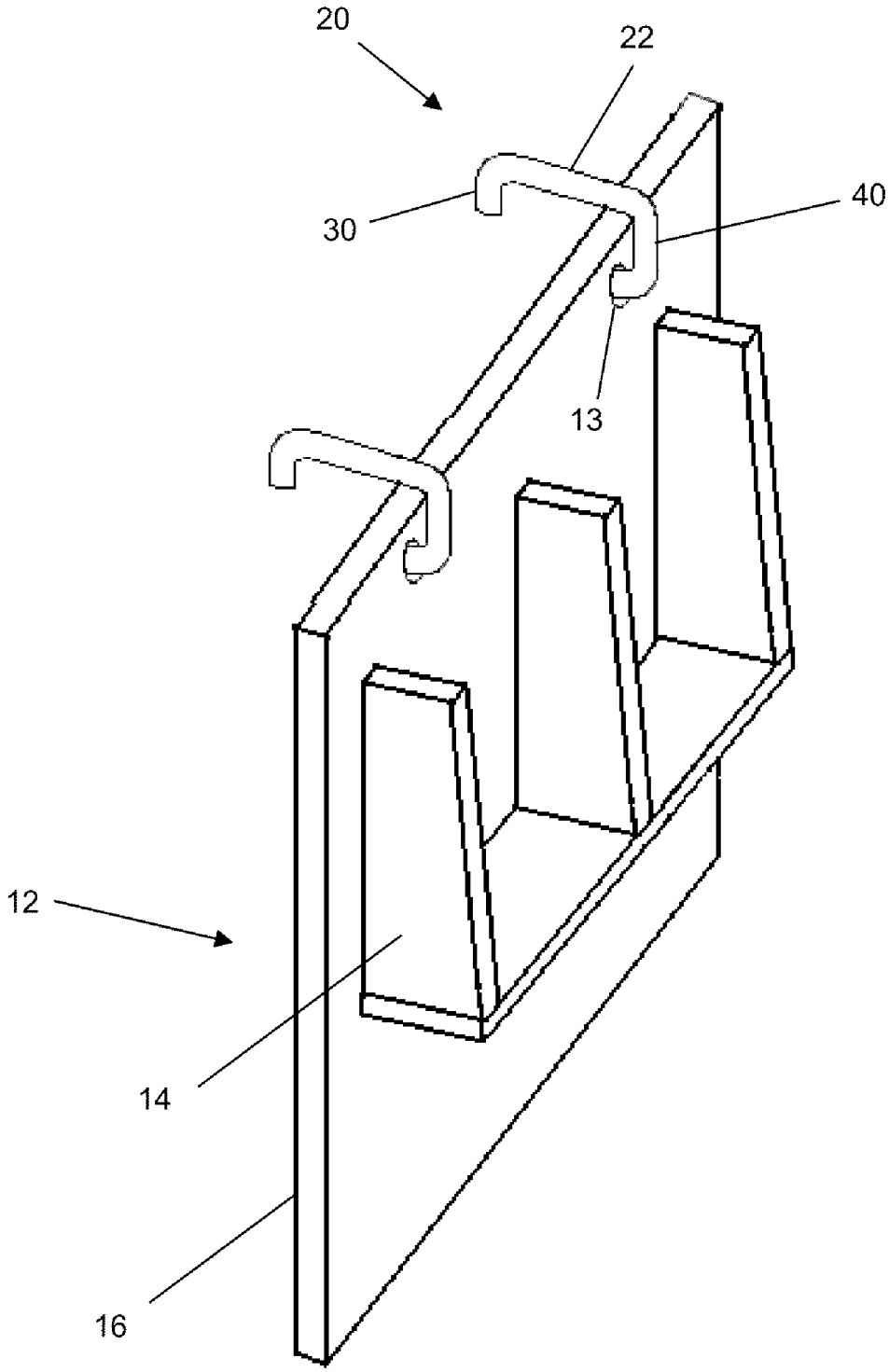
FIG. 4 is a perspective view of an exemplary storage accessory that could be used instead of a board according to another embodiment of the present invention.

The board 12 may be a simple board, but may also be a board-like object that provides additional functionality, such as a dry erase board, chalkboard, peg board, or the like. The board 12 can also have a variety of configurations, such as to provide more storage space, accommodate decorative or utilitarian objects, hold small utensils and the like. For example, FIG. 4 shows another embodiment of the board 12 comprising a flat plate 14 and shelves 16 mounted to the outer surface flat plate 14. The flat plate 14 includes apertures 13 to receive the hooks 20, as is also the case with board 12.

Figure 5:
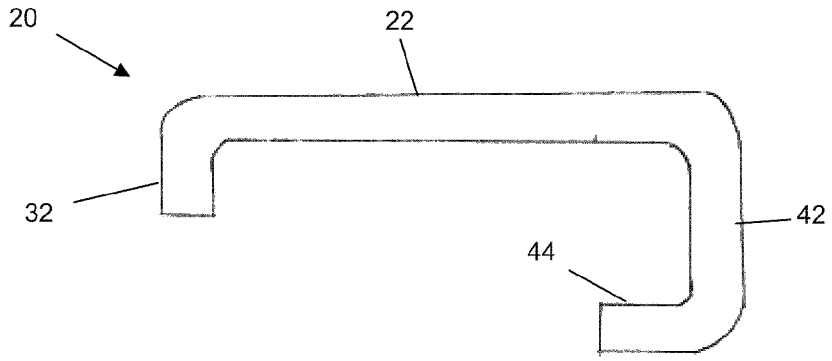
FIG. 5 is a front view of the hanging hook according to an exemplary embodiment of the present invention.

FIG. 5 illustrates a hanging hook 20 according to an exemplary embodiment of the present invention. The hook 20 comprises a central portion 22 and attachment portions 30 and 40 disposed at opposite ends of the central portion 22.

The central portion 22 extends a lateral distance that is equal to or greater than of the thickness of the board 12 or plate 14. In other words, the central portion 22 spans the thickness of the board 12 or plate 14, and may extend out to or beyond the outer surfaces of the board 12 or plate. The central portion 22 is preferably a substantially straight lateral segment as shown in FIG. 5, but may also be configured to include a vertical component, such a bending the central portion 22 into a curved arch or by bending the central portion 22 into two or more segments. The central portion 22 of the hook 20 may also be decorative.

The first attachment portion 30 includes a leg portion 32 at one end of the central portion 22 that extends downward from the central portion 22. Preferably, the leg portion 32 extends downward a vertical distance that is less than or equal to the thickness of the upper wall 2 of the modular storage cube 10. However, the leg portion 32 may also extend a vertical distance that is slightly greater than the thickness of the upper wall 2 of the modular storage cube 10.

The second attachment portion 40 includes a leg portion 42 that extends downward from the opposite end of the central portion 22 and an arm portion 44 that extends inward from the distal end of the leg portion 42 toward the center of the hook 20. The leg portion 42 extends downward a vertical distance greater than the thickness of the upper wall 2 of the modular storage cube 10, preferably a distance greater than the distance of the leg portion 32.

In one embodiment such as shown in FIG. 5, the leg portions 32 and 42 may be substantially transverse to the central portion 22 such that the leg portions 32 and 42 extend substantially vertically downward. The arm portion 44 may be substantially transverse to the leg portion 42 such that the arm portion 44 is substantially parallel to the central portion 22.

Figure 6:
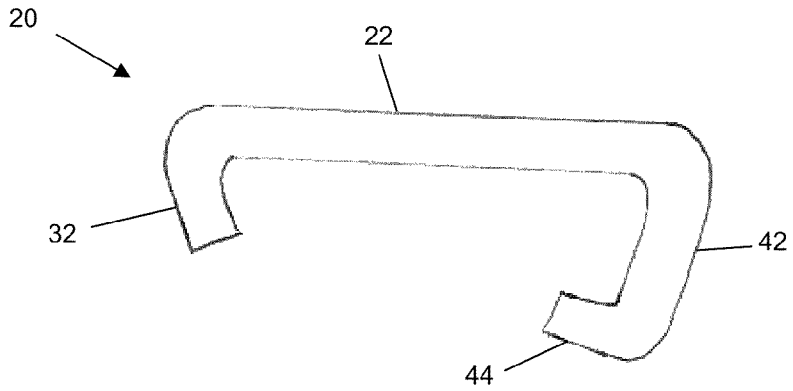
FIG. 6 is a front view of the hanging hook according to another exemplary embodiment of the present invention.

In another embodiment such as shown in FIG. 6, one or both the leg portions 3 may be inclined inwardly. For example, the angle between the leg portion 42 and the arm portion 44 may be an acute angle instead of a right angle.

Figure 7:
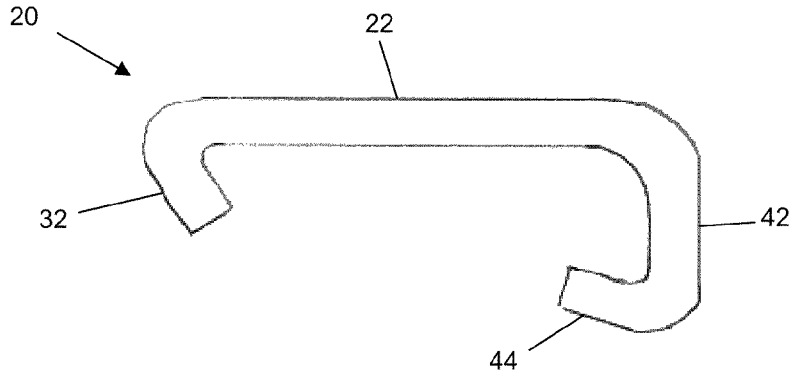
FIG. 7 is a front view of the hanging hook according to another exemplary embodiment of the present invention.

In another embodiment, the arm portion 44 may be inclined upwardly. For example, the incline of the arm portion 44 may be due to the configuration of the leg portions 42 such as shown in FIG. 5, wherein the angle between the central portion 22 and the leg portion 44 is an acute angle instead of a right angle. The arm portions 28 may also be inclined upwardly by configuring the angle between the leg portion 42 and the arm portion 44 being an acute angle instead of a right angle such as shown in FIG. 7.

The hook 20 may embody a single integral piece, however a plurality of pieces may also be joined together to form the hook 20. The hook 20 may be comprised of a rigid or semi-rigid material, such as metal, plastic, wood, an elastomer, or the like. Portions of the hook 20 may incorporate decorative features.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A hanging hook for attaching a generally vertical object to a vertical side wall of a piece of storage furniture, the object comprising an inner side surface, an outer side surface and a top side wall extending between the inner and outer side surfaces, the hanging hook comprising:

a central portion extending laterally across the width of the top side wall of said object;

a first attachment portion at one end of said central portion, the first attachment portion including a leg section extending downward and over the outer side surface of the object and an arm section extending inward from a distal end of the leg section toward the center of said hanging hook for securing said arm section through an aperture in the outer side surface of said object; and a second attachment portion at the opposite end of said central portion, the second attachment portion including a leg section extending downward for securing said leg portion through an aperture in a top surface of said piece of storage furniture so that the object is secured to the vertical side wall of the piece of storage furniture and the inner side surface of the object is disposed in a face-to-face configuration with the vertical side wall of the piece of storage furniture.

2. The hook of claim 1, wherein said leg section of said first attachment portion extends substantially vertically downward.

3. The hook of claim 1, wherein said leg section of said first attachment portion is inclined inwardly.

4. The hook of claim 1, wherein said leg section of said second attachment portion extends substantially vertically downward.

5. The hook of claim 1, wherein said leg section of said second attachment portion is inclined inwardly.

6. A modular storage furniture system comprising:

a piece of storage furniture;

a board having an inner side surface, an outer side surface and a top side wall extending between the inner and outer side surfaces; and at least one hanging hook for securing said board oriented generally vertically to a vertical side wall of said piece of storage furniture with the inner side surface of the board disposed in a face-to-face configuration with the vertical side wall of the piece of storage furniture, said hook comprising:

a central portion extending laterally across the thickness of the top side wall of said board;

a first attachment portion at one end of said central portion, the first attachment portion including a leg section extending downward for engagement through an aperture in a top surface of said piece of storage furniture; and a second attachment portion at the opposite end of said central portion, the second attachment portion including a leg section extending downward and over the outer side surface of the board and an arm section extending inward from a distal end of the leg section toward the center of said hanging hook for engagement through an aperture in the outer side surface of said board.

7. The system of claim 6, wherein said leg section of said first attachment portion of said hook extends substantially vertically downward.

8. The system of claim 6, wherein said leg section of said first attachment portion of said hook is inclined inwardly.

9. The system of claim 6, wherein said leg section of said second attachment portion of said hook extends substantially vertically downward.

10. The system of claim 6, wherein said leg section of said second attachment portion of said hook is inclined inwardly.

11. The system of claim 6, wherein said board comprises:

a flat plate; and a storage accessory mounted on an outer side surface of said flat plate.

* * * * *